United States Patent [19]

Fries et al.

[11] Patent Number: 5,074,410

[45] Date of Patent: Dec. 24, 1991

[54] HINGED PORTABLE HAT BOX HAVING STRAP ABUTMENTS

[75] Inventors: Kenneth C. Fries, Leo; Steven T. Gerber, Fort Wayne, both of Ind.

[73] Assignee: Coppers Ltd., Fort Wayne, Ind.

[21] Appl. No.: 605,146

[22] Filed: Oct. 29, 1990

Related U.S. Application Data

[63] Continuation of Ser. No. 417,445, Oct. 5, 1989, abandoned.

[51] Int. Cl.[5] ..... B65D 85/18

[52] U.S. Cl. ..... 206/8; 190/117; 223/24; 223/84

[58] Field of Search ..... 206/8, 9; 190/118, 117, 190/115; 220/4 B; 223/24, 12, 84

[56] References Cited

U.S. PATENT DOCUMENTS

| | | | |
|---|---|---|---|
| 870,550 | 11/1907 | Dod | 206/8 |
| 1,638,568 | 8/1927 | Dreyfus | 206/8 |
| 2,259,930 | 10/1941 | Gawelek | 223/84 |
| 2,283,660 | 5/1942 | Widmann | 223/24 |
| 2,309,029 | 1/1943 | Leary, Jr. | 190/115 |
| 2,494,487 | 1/1950 | Pfeil | 206/9 |
| 2,586,700 | 2/1952 | Noble | 206/8 |
| 2,931,488 | 4/1960 | Trudeau | 206/8 |
| 3,036,698 | 5/1962 | Groneweyer | 206/8 |
| 3,324,994 | 6/1967 | Rauser, Sr. | 206/8 |
| 3,391,765 | 7/1968 | Baker | 190/117 |
| 3,891,070 | 6/1975 | Montanari | 220/4 B X |

FOREIGN PATENT DOCUMENTS

| | | | |
|---|---|---|---|
| 2318603 | 2/1977 | France | 190/118 |
| 312353 | 11/1933 | Italy | 206/8 |
| 18707 | of 1892 | United Kingdom | 206/8 |

*Primary Examiner*—Bryon P. Gehman

*Attorney, Agent, or Firm*—Lundy & Associates

[57] ABSTRACT

A portable hat box for a brimmed hat having an upper member and a lower member. The upper member being pivotal relative to the lower member about a pivot axis between a closed position and an open position. The members in the closed position completely enclose a hat chamber. Each of the members having a platen surface. The lower member platen surface is substantially complementary in shape to the upper member platen surface. The platen surfaces are adjacent having a substantially constant vertical clearance therebetween in the closed position. The platen surfaces are nonadjacent and obliquely related in the open position.

15 Claims, 4 Drawing Sheets

HINGED PORTABLE HAT BOX HAVING STRAP ABUTMENTS

This is a continuation of co-pending application Ser. No. 07/417,445 filed on Oct. 5, 1989, now abandoned.

BACKGROUND OF THE INVENTION

The present invention pertains to storage containers and more particularly pertains to a portable hat box.

Troopers and Officers of law enforcement organizations and others who wear campaign type hats have long had difficulties in storing and maintaining campaign hats in serviceable condition. For example, Troopers need to store hats in a patrol vehicle or at home when not worn or store a second hat in case an original hat becomes dirtied or crumpled. Safe storage and transportation of campaign hats presents a problem. Similarly, a slightly damaged hat needs to be stored and transported so as not to exacerbate existing crumpling and needs to be reshaped within a relatively short time to prevent permanent damage. Existing hat boxes have a variety of shortcomings, such as being inappropriate for rough usage, for example, loose placement in the trunk of a vehicle, not being weatherproof, being configured so as to be difficult to transport, or lacking provisions for reshaping a campaign hat.

It is therefore highly desirable to provide an improved, portable hat box.

It is also highly desirable to provide an improved, portable hat box which is weatherproof and capable of withstanding rough usage.

It is also highly desirable to provide an improved, portable hat box which can be opened and closed to insert and remove a campaign hat single handedly.

It is also highly desirable to provide an improved, portable hat box which can protect a campaign hat from both sun and moisture.

It is also highly desirable to provide an improved, portable hat box which can reshape the brim of a crumpled campaign hat.

It is also highly desirable to provide an improved, portable hat box which can block the brim and protect the crown of a campaign hat.

It is finally highly desirable to provide an improved, portable hat box which meets all of the above desired features.

SUMMARY OF THE INVENTION

It is an object of the invention to provide an improved, portable hat box.

It is another object of the invention to provide an improved hat box which is weatherproof and capable of withstanding rough usage.

It is also highly desirable to provide an improved, portable hat box which can be opened and closed to insert and remove a campaign hat single handedly.

It is also highly desirable to provide an improved, portable hat box which can protect a campaign hat from both sun and moisture.

It is another object of the invention to provide an improved, portable hat box which can reshape the brim of a crumpled campaign hat.

It is another object of the invention to provide an improved, portable hat box which can block the brim and protect the crown of a campaign hat.

In the broader aspects of the invention there is provided an improved, portable hat box for a brimmed hat having an upper member and a lower member. The upper member being pivotal relative to the lower member about a pivot axis between a closed position and an open position. The members in the closed position completely enclose a hat chamber. Each of the members having a platen surface. The lower member platen surface is substantially complementary in shape to the upper member platen surface. The platen surfaces are adjacent having a substantially constant vertical clearance therebetween in the closed position. The platen surfaces are nonadjacent and obliquely related in the open position.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
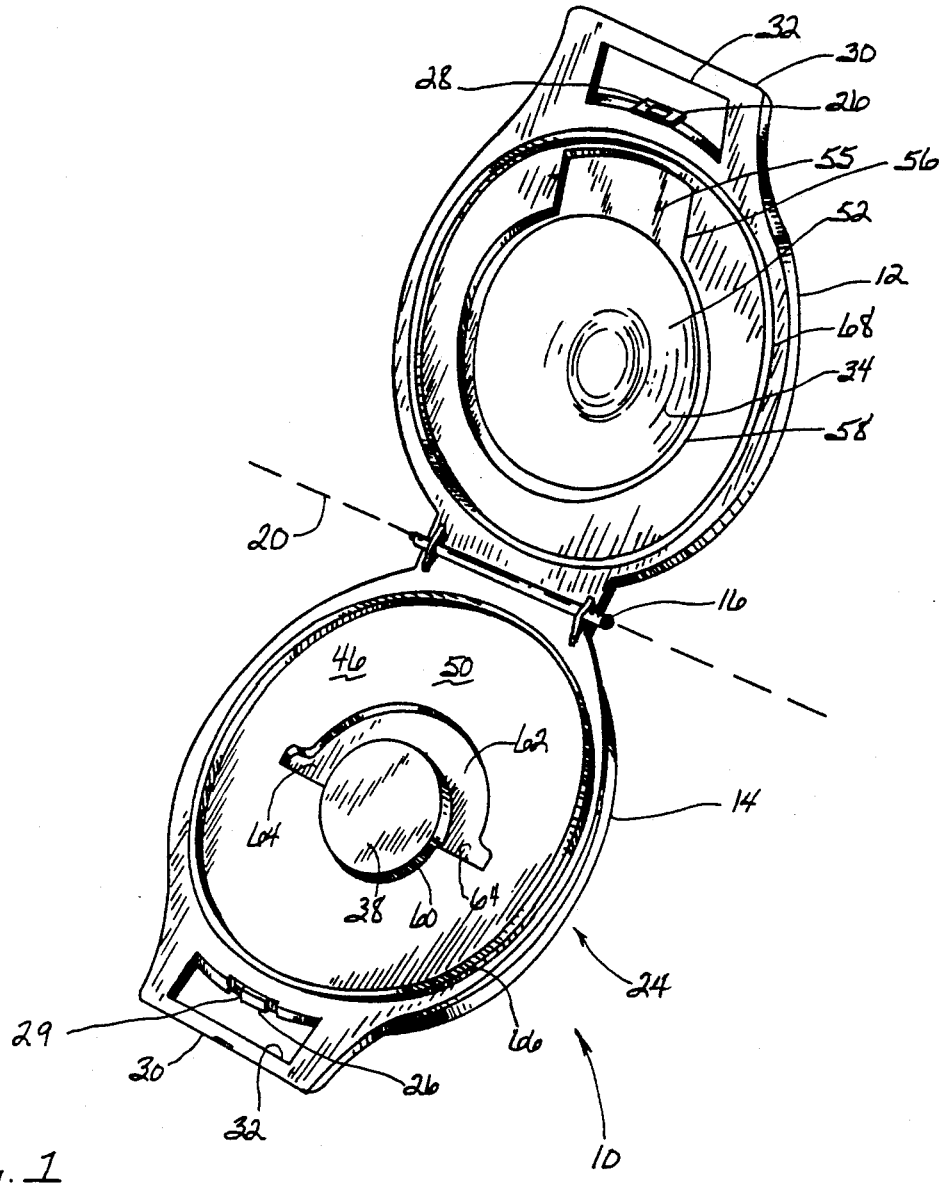
FIG. 1 is a perspective view of an embodiment of the portable hat box of the invention. The members of the portable hat box are in an open position.
Figure 2:
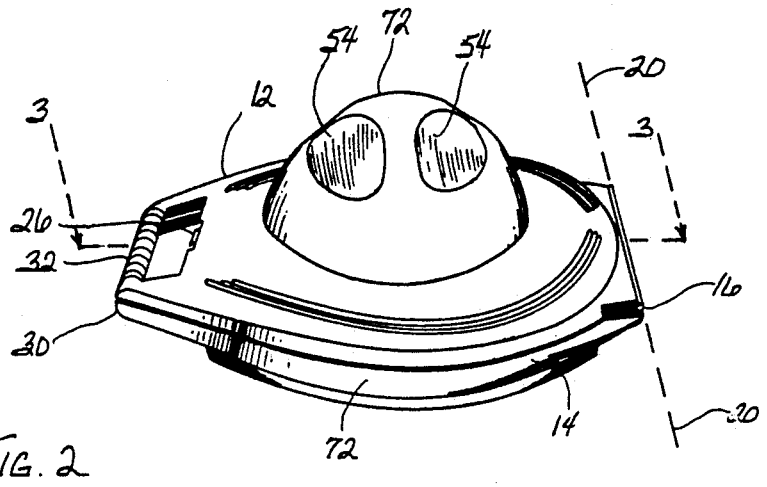
FIG. 2 is a perspective view of the portable hat box of FIG. 1 showing the member in a closed position.

Referring now to FIGS. 1 and 2, the portable hat box 10 of the invention has an upper member 12 and a lower member 14. Members 12, 14 each have a hinge part 16, 18, respectively, which are joined together to define a pivot axis 20. Upper member 12 is pivotable relative to lower member 14, about pivot axis 20, between a closed position 22, shown in FIG. 2, an open position 24 illustrated in FIG. 1 and a plurality of other open positions there between (not illustrated).

Opposite pivot axis 20 is a latch 26, which has latch parts 28, 29 joined to members 12, 14. Handles 30 are also opposite pivot axis 20, exterior to latch 26. Each handle 30 is integral with a respective member 12, 14. Handles 30 each have a grip 32 which are parallel to pivot axis 20. Grips 32 may be knurled or the like for easier grasping. In a particular embodiment of the invention, grips 32 each have the shape, in vertical cross-section of opposite halves of a circle.

Figure 3:
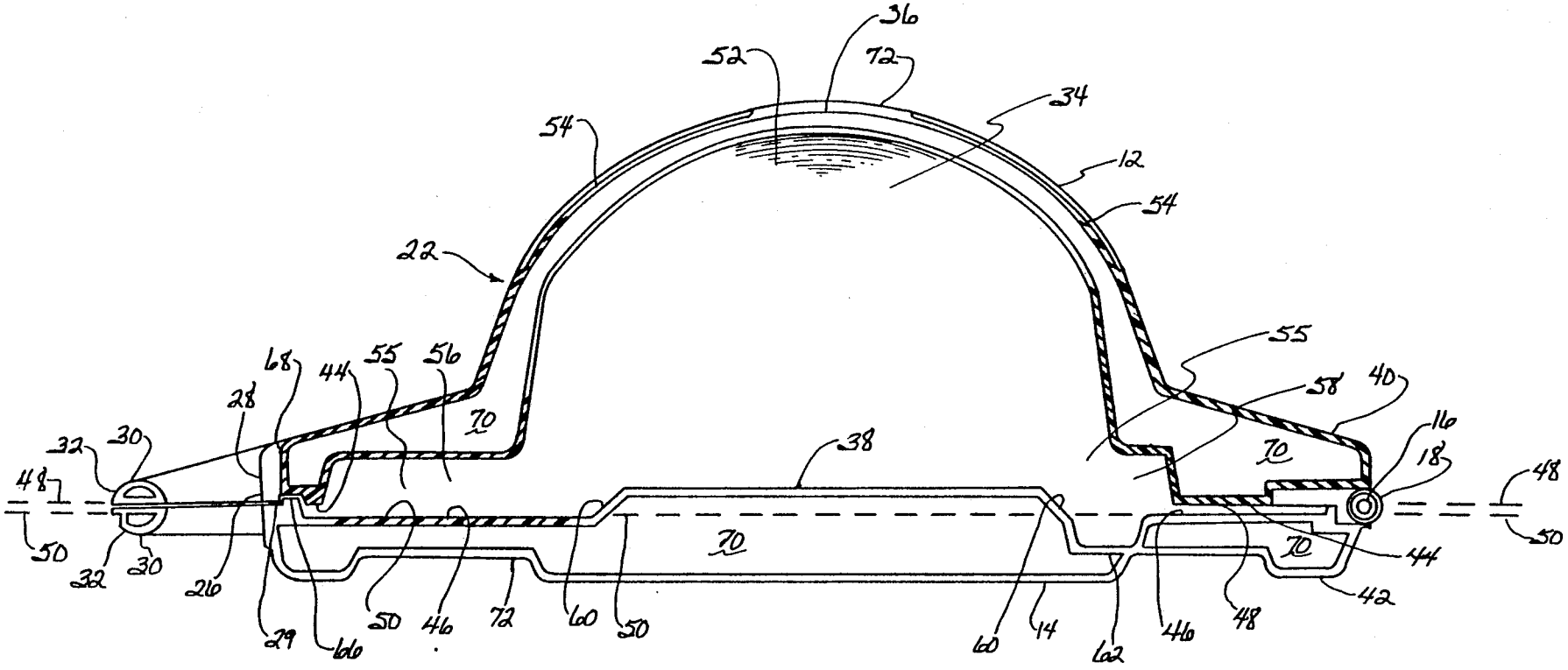
FIG. 3 is a cross-sectional view of the portable hat box of FIG. 1 taken along section line 3—3 of FIG. 2.
Figure 4:
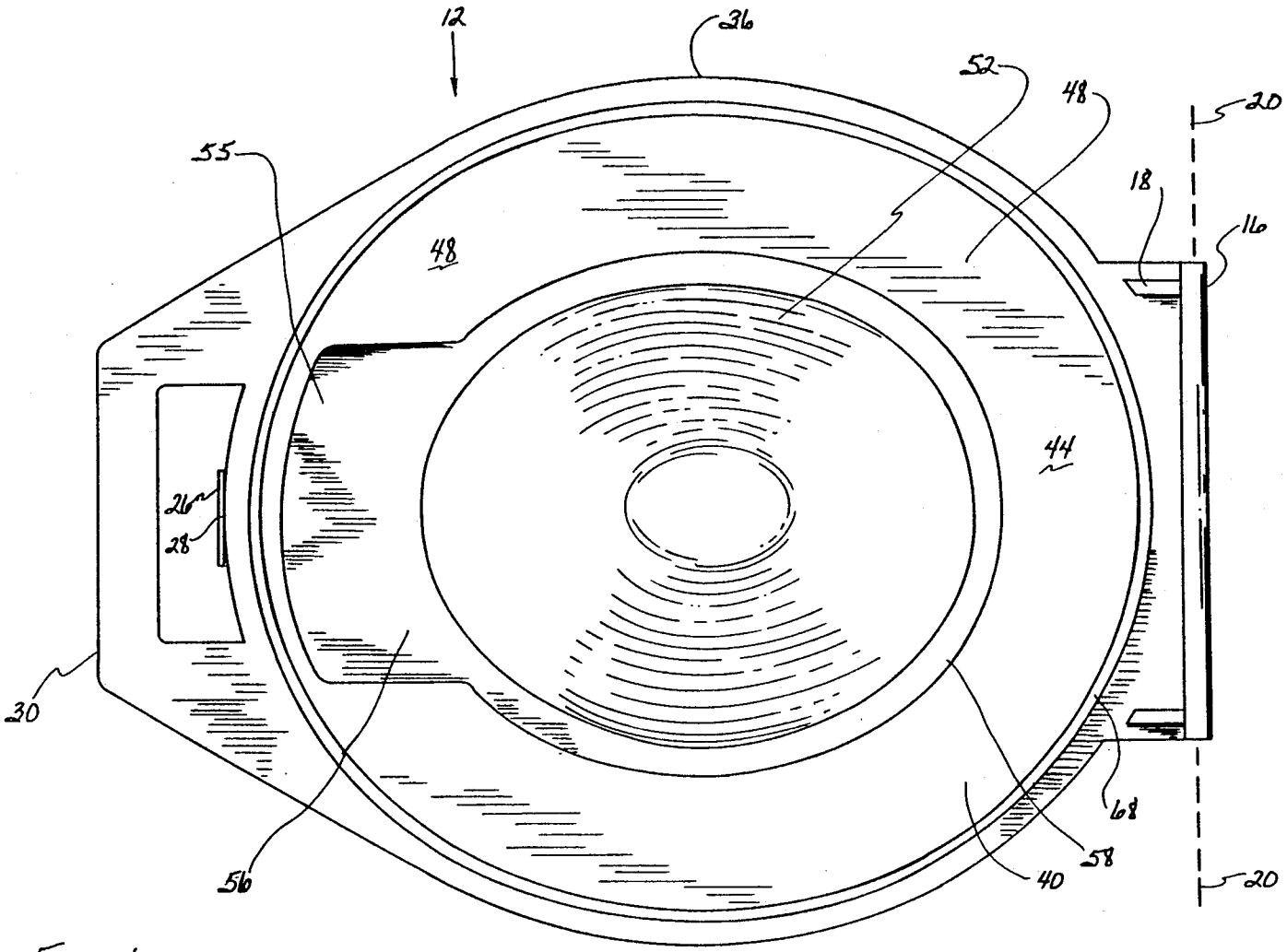
FIG. 4 is a bottom plan view of the upper member of the portable hat box of FIG. 1.
Figure 5:
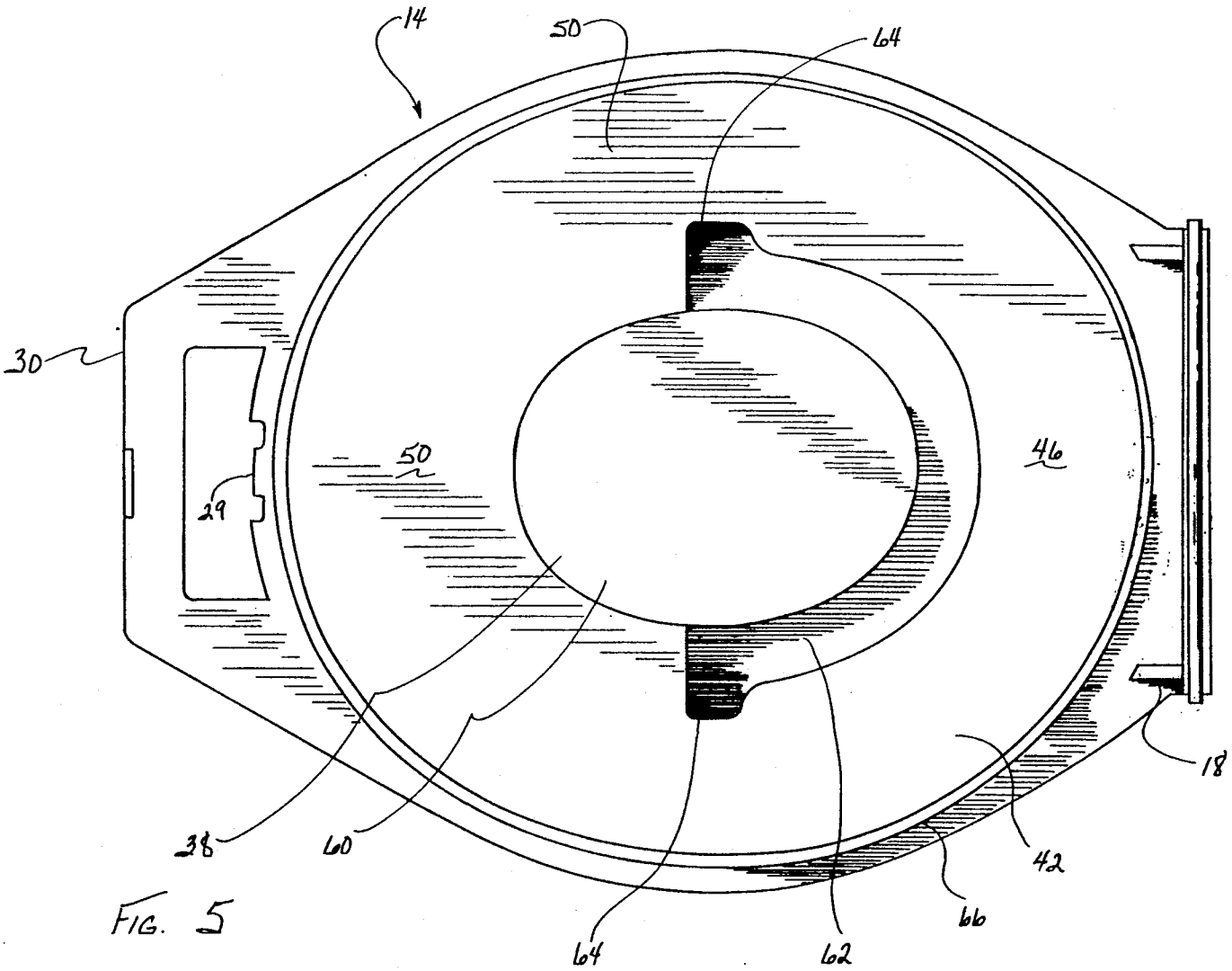
FIG. 5 is a top plan view of the lower member of the portable hat box of FIG. 1.

Referring now to FIGS. 3, 4, and 5, members 12, 14 surround and completely enclose a hat chamber 34. Each member 12, 14 has a core portion 36, 38, respectively, and a brim portion, 40, 42, respectively.

Brim portions 40, 42 are each generally annular in shape and circumscribe the respective core portions 36, 38. Each brim portion 40, 42 has a substantially annular platen surface 44, 46. When members 12, 14 are in closed position 22, upper and lower platen surfaces 44, 46 are completely enclosed within hat chamber 34, face each other and are separated by a uniform clearance about equal to the thickness of the brim of a campaign hat (not shown).

Platen surfaces 44, 46 are complementary in shape and, in a particular embodiment of the invention, are planar. In that embodiment, when members 12, 14 are in closed position 22, platen surfaces 44, 46 are parallel.

When members 12, 14 are in open position 24, platen surfaces 44, 46 are oblique to each other. Pivot axis 20 lies in a first plane 48 defined by upper platen surface 44 and is spaced apart from a second plane 50 defined by lower platen surface 46.

Upper core portion 36 extends upwardly from upper brim portion 40 and defines a crown subchamber 52 of hat chamber 34. Upper core portion 36 may have decorative crown indents 54, which protrude into crown subchamber 52. In a particular embodiment of the invention, four smoothly rounded crown indents 54 are evenly spaced around the top of crown subchamber 52. Adjoining and circumscribing crown subchamber 52 is decoration subchamber 55, which has a substantially annular main portion 58 and extending from one end, and enlarged front portion 56.

Extending up from lower brim portion 42 and extending through first plane 48 is lower core portion 38, which has roughly the same shape in horizontal cross-section as crown subchamber 52, but has smaller horizontal dimensions. Edge 60 of lower core portion 38 is sloped inwardly. Adjoining lower core portion 38 and extending slightly more than half-way around lower core portion 38 is strap subchamber 62. To the outside, strap subchamber 62 is bordered by lower platen surface 46. Strap subchamber 62 is recessed below second plane 50. At the ends of strap subchamber 62, furthest from pivot axis 20, are a pair of strap abutments 64, which are substantially perpendicular to second plane 50, tangential to and equidistant from pivot axis 20.

Encircling and adjoining platen surfaces 44, 46, respectively, are a continuous groove 66 and a complementary continuous tongue 68, respectively. Tongue 66 and groove 68 are inset from pivot axis 20 and latch 26. Tongue 66 and groove 68 are configured so as to render hat chamber 34 essentially dust tight and weatherproof when members 12, 14 are in closed position 22.

In a particular embodiment of the invention, members 12, 14 are each made out of a plastic, which in moderate section is substantially rigid and in thin section is sufficiently flexible to act as a continuous hinge for a latch 26. In that embodiment, hinge parts 16, 18 and latch parts 28, 29 are integral with respective members 12, 14. In that embodiment, members 12, 14 are double layered with a separating air space 70. Since the air spaces 70 are enclosed they provide flotation. Outer surfaces 72 of members 12, 14 may generally be shaped as required to provide structural strength.

In use, portable hat box 10 is opened and a campaign hat (not shown) is placed inside. The hat is oriented so that a decoration at the front of the hat, such as the crossed loose ends of a band, faces handles 30 by the hat strap and strap subchamber 62. Where the brim of the hat lies on lower platen surface 46, the hat strap lies in subchamber 62 and the hat decoration is positioned subchamber 55. Upper member 12 is then pivoted toward lower member 14 and portable hat box 10 is closed and latched. If the hat is positioned otherwise, the hat box 10 cannot be closed and latched.

Closing portable hat box 10 causes the brim of the hat to be compressed between upper and lower platen surfaces 44, 46, which reshapes the brim to eliminate crumpling. The offset of one of platen surfaces 44, 46 from pivot axis 20 prevents any portion of brim from excess compression. Handles 30 are positioned opposite pivot axis 20 to provide leverage. At the same time, core portion 36 of upper member 12, encloses the crown of the hat. Blocking, if necessary, should be performed by the user, before closing the portable hat box 10. During closing of portable hat box 10, creep of the hat along platen surfaces 44, 46 and attendant crumpling is deterred by the alignment caused by the engagement of strap buckles with strap abutments 64 and by the alignment caused by the slippage of the hat off lower core portion 38 due to sloped edge 60. Tongue 68 and groove 66 are engaged in closed position 22 o preclude the entry of dust and dirt, and to render the hat box 10 weathertight.

In alternative embodiments of the invention, platen surfaces 44, 46 rather than being planar may have complex complimentary shapes.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A portable hat box for a brimmed hat, said portable hat box comprising an upper member and a lower member, said members each having opposite ends, said upper and lower members being joined by a pivot at one of said ends, said members being pivotably movable between a closed position and an open position about the pivot axis of said pivot, said members in said closed position completely enclosing a hat chamber, said members each having a platen surface, one of said upper and lower members having strap abutments extending thereinto from the platen surface thereof and forming a part of said hat chamber, said hat chamber having a sub-chamber adjoining and connecting said abutments said sub-chamber also extending into said one member from the platen surface of said one member.

2. The portable hat box of claim 1 wherein said strap abutments are spaced apart and substantially equidistant from said pivot axis.

3. The portable hat box of claim 1 wherein said pivot axis is coplanar with one of said platen surfaces.

4. The portable hat box of claim 1 wherein one f said members has an encircling groove and the other of said members has an encircling tongue complementary in shape to said groove, said tongue and said groove each being adjacent to the platen surface of its respective member, said members sealingly enclosing said hat chamber in said closed position thereby substantially isolating said hat chamber from the ambient environment.

5. The portable hat box of claim 4 wherein said pivot axis is exterior to said tongue and said groove.

6. The portable hat box of claim 1 wherein said lower member has a raised hat centering core portion circumscribed by the lower platen surface.

7. The portable hat box of claim 6 wherein the strap abutments are on opposite sides of said core portion.

8. The portable hat box of claim 6 wherein said raised core portion has an inwardly sloped edge angularly disposed to said platen surfaces.

9. The portable hat box of claim 1 wherein said upper member defines a decoration chamber adjoining the upper platen surface, said decoration chamber being continuous with said hat chamber, said decoration chamber having a substantially annular main portion and an enlarged portion extending outwardly from said main portion, said decoration chamber extending into said upper member from said upper platen surface.

10. The portable hat box of claim 1 wherein said members have complementary hinge halves integral with respective said members, said hinge halves defining a hinge, and a latch attached to said members opposite said hinge, said latch being integral with said members.

11. The portable hat box of claim 1 wherein the lower member platen surface is substantially complementary in shape to the upper member platen surface, said platen surfaces being spaced but adjacent to each other and having a substantially constant vertical clearance therebetween in said closed position, said vertical clearance is about the thickness of the brim of a hat whereby the brim of a hat in said hat box is blocked by said platen surfaces in said closed position, said platen surfaces are non-adjacent and obliquely related in said open position, said members each having handle portions opposite said pivot axis, said handle portions being latchable together to form a handle for said hat box and to hold said members in said closed position.

12. The portable hat box of claim 11 wherein said handle portions are each integral with a respective one of said members and each of said handle portions has a grip portion substantially parallel to said pivot axis.

13. The portable hat box of claim 1 wherein the upper member platen surface defines a first plane and the lower member platen surface defines a second plane.

14. The portable hat box of claim 13 wherein said pivot axis lies in said first plane and is spaced apart from said second plane.

15. A portable hat box for a campaign hat with a chin strap and decoration, said portable hat box comprising an upper member and a lower member, said members each having opposite ends, said upper and lower members being joined by a pivot at adjacent ones of said ends, said members being pivotably movable between a closed position and an open position about the pivot axis of said pivot, said members in said closed position completely enclosing a hat chamber, said members each having a platen surface, the lower member platen surface being substantially complementary in shape to the upper member platen surface, said platen surfaces being spaced but adjacent to each other and having a substantially constant vertical clearance therebetween in said closed position, said vertical clearance being about the thickness of the brim of a hat whereby the brim of a hat in said hat box is blocked by said platen surfaces in said closed position, said platen surfaces being non-adjacent and obliquely related in said open position, said members each having handle portions opposite said pivot axis, said handle portions being latchable together to form a handle for said hat box and to hold said members in said closed position, said lower member having a pair of strap abutments extending into said lower platen surface and forming a part of said hat chamber, and wherein said hat chamber has a strap subchamber adjoining and connecting said strap abutments, said strap subchamber also being defined by said lower member, said strap subchamber also extending into said lower member from said lower platen surface and forming a part of sad hat chamber, said upper member having a decoration chamber adjoining said upper platen surface, said decoration chamber being continuous with said hat chamber, said decoration chamber having a substantially annular main portion and an enlarged portion extending outwardly from said main portion, said decoration chamber extending into said upper member from said upper platen surface and forming a part of said hat chamber.

* * * * *